US010040612B2

(12) United States Patent
Kuipers

(10) Patent No.: US 10,040,612 B2
(45) **Date of Patent: *Aug. 7, 2018**

(54) SEPARATOR SYSTEM FOR ORGANIZING ITEMS

(71) Applicant: Joseph P. Kuipers, Nokomis, FL (US)

(72) Inventor: Joseph P. Kuipers, Nokomis, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/976,763

(22) Filed: Dec. 21, 2015

(65) Prior Publication Data

US 2016/0176596 A1 Jun. 23, 2016

Related U.S. Application Data

(60) Provisional application No. 62/095,649, filed on Dec. 22, 2014.

(51) Int. Cl.

| | |
|---|---|
| ***A47F 1/04*** | (2006.01) |
| ***A47F 7/00*** | (2006.01) |
| ***A47F 7/14*** | (2006.01) |
| ***B65D 57/00*** | (2006.01) |
| ***A47F 7/22*** | (2006.01) |

(Continued)

(52) U.S. Cl.

CPC ..... *B65D 57/00* (2013.01); *A47B 87/0261* (2013.01); *A47B 87/0269* (2013.01); *A47F 7/0007* (2013.01); *A47F 7/22* (2013.01); *A47B 61/003* (2013.01); *A47B 87/0253* (2013.01)

(58) Field of Classification Search

CPC ..... B65D 71/70; B65D 57/00; B65D 21/048; B65D 21/0219; B65D 21/0233; B65D 21/04; A47G 25/00; A47G 25/72; A47F 7/19; A47F 7/22; A47F 7/24; A47F 7/28; A47F 7/0007; A47F 7/0014; A47F 7/141; A47B 61/00; A47B 87/0207; A47B 87/02; A47B 87/0261; A47B 87/0269; A47B 87/0223; A47B 61/003; A47B 87/0253; B42F 7/12

USPC ..... 211/59.4, 85.3, 194, 126.2, 49.1, 50, 211/126.7, 126.12; 206/557, 278, 503, 206/505, 509, 511, 512; 223/37, 120

See application file for complete search history.

(56) References Cited

U.S. PATENT DOCUMENTS 1,890,143 A * 12/1932 Bales ..... B42F 7/12 206/449
2,684,766 A * 7/1954 Blom ..... B65D 21/048 206/499

(Continued)

FOREIGN PATENT DOCUMENTS

| | | |
|---|---|---|
| DE | 42 40 611 | 12/1992 |
| GB | 742515 | 12/1955 |

*Primary Examiner* — Jennifer E Novosad

(74) *Attorney, Agent, or Firm* — Frijouf, Rust & Pyle P.A.

(57) ABSTRACT

A separator system is disclosed for organizing items such as fabrics and wearing apparel as well as documents and the like. The separator system comprises a first planar member defined by a first peripheral portion for supporting a first item. A first hollow projection is formed in the first peripheral portion of the first planar member. The first hollow projection defines an first upper projection and a first lower recess. The first upper projection of the first hollow projection extends above the first item for interlocking with a second lower recess of an adjacent second planar member located above the first item.

5 Claims, 15 Drawing Sheets

(51) Int. Cl.
*A47B 87/02* (2006.01)
*A47B 61/00* (2006.01)

(56) References Cited

U.S. PATENT DOCUMENTS 3,003,647 A * 10/1961 Lockwood ..... B65D 21/048 206/505
3,141,554 A * 7/1964 Sussman ..... B65D 21/041 211/126.4
3,294,246 A * 12/1966 Oppenheim ..... A47F 1/04 211/59.4
3,574,432 A * 4/1971 Hansmann ..... A47B 63/00 312/111
4,042,108 A * 8/1977 Brethauer ..... B65D 71/70 206/392
4,109,982 A 8/1978 Schreyer
4,139,097 A * 2/1979 Bowman ..... B42F 7/12 206/425
4,266,714 A * 5/1981 Crane ..... B65D 5/004 206/509
4,305,217 A 12/1981 Green et al.
4,441,615 A * 4/1984 Goodrich ..... B65D 21/041 206/505
4,795,196 A 1/1989 Hyun et al.
4,821,885 A * 4/1989 Ondrasik ..... B65D 21/048 206/505
5,040,681 A * 8/1991 Grusin ..... A45C 7/00 206/371
5,154,291 A * 10/1992 Sur ..... G11B 33/0483 206/308.1
5,186,338 A * 2/1993 Boutet ..... G03B 42/045 108/53.1
5,191,983 A * 3/1993 Hardy ..... A47B 81/067 206/308.1
5,284,258 A * 2/1994 Genero ..... F16B 2/205 211/46
5,318,182 A * 6/1994 Thorud ..... A47B 63/02 206/509
5,447,234 A * 9/1995 Faulstick ..... B65D 25/06 206/449
5,456,366 A * 10/1995 Wenkman ..... B42F 7/12 211/11
5,505,371 A 4/1996 O'Neill
5,577,620 A * 11/1996 Jacob ..... A47B 81/068 206/309
5,634,555 A * 6/1997 Dunham ..... B65D 5/5059 206/19
5,634,559 A * 6/1997 Foos ..... B65D 11/188 206/308.1
5,810,457 A 9/1998 Felsenthal et al.
5,918,743 A * 7/1999 Uitz ..... B65D 11/1833 206/509
6,026,553 A * 2/2000 Brunelle ..... B65D 21/0209 206/509
6,062,388 A * 5/2000 Ohayon ..... B65D 21/0216 206/507
6,318,822 B1 11/2001 Wang
D501,341 S 2/2005 Cassidy et al.
D502,031 S 2/2005 Cassidy et al.
D505,809 S 6/2005 Cassidy et al.
7,296,698 B2 * 11/2007 McClure ..... A47B 43/00 206/516
7,334,669 B2 2/2008 Barker et al.
7,779,976 B2 8/2010 Mangano
8,376,477 B2 2/2013 Schinzing
8,714,418 B2 5/2014 Kumar et al.
2002/0096447 A1 * 7/2002 Lafond ..... B65D 21/0228 206/456
2004/0084387 A1 * 5/2004 Chang ..... B42F 7/12 211/11
2004/0129655 A1 * 7/2004 Balzarini ..... B65D 21/048 211/11
2005/0236348 A1 * 10/2005 Killinger ..... B42F 7/12 211/126.7
2007/0209960 A1 * 9/2007 Leoncavallo ..... A61J 1/16 206/509
2008/0143222 A1 6/2008 Greiner
2008/0308439 A1 * 12/2008 Lidster ..... B32B 27/10 206/423
2009/0223853 A1 * 9/2009 Kim ..... B65D 45/22 206/509
2010/0276241 A1 11/2010 Malone
2016/0176596 A1 * 6/2016 Kuipers ..... B65D 57/00 211/85.3

* cited by examiner

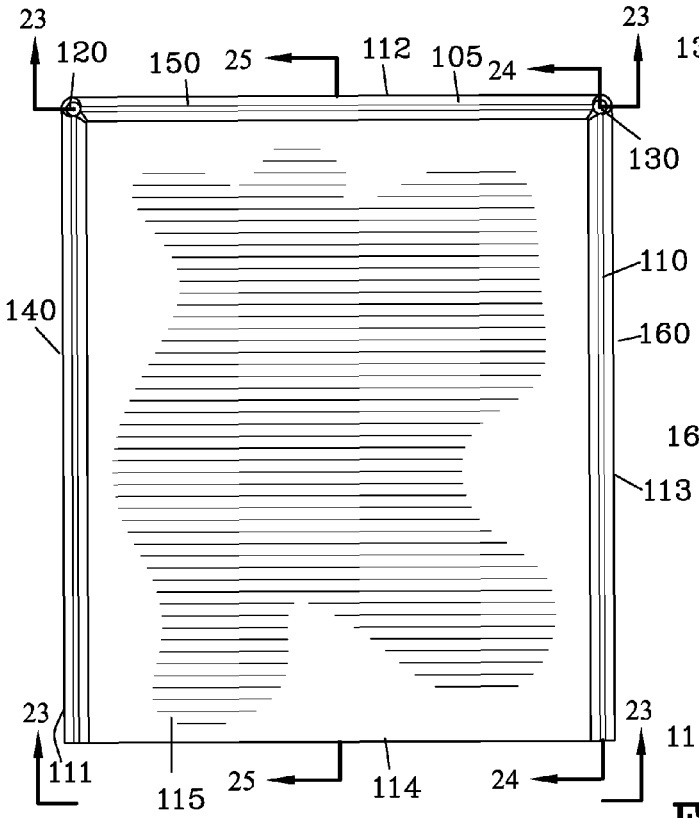
FIG. 20
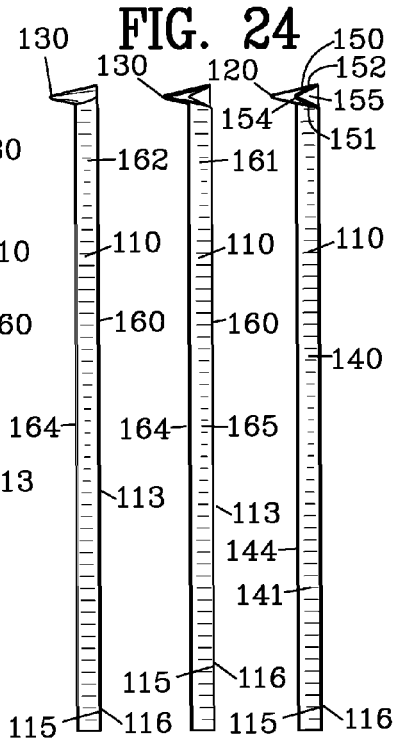
FIG. 24
FIG. 21 FIG. 25
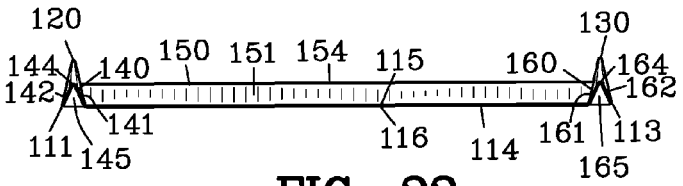
FIG. 22
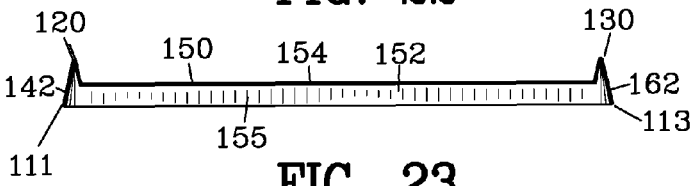
FIG. 23

SEPARATOR SYSTEM FOR ORGANIZING ITEMS

CROSS-REFERENCE TO RELATED APPLICATIONS

This application claims benefit of U.S. Patent Provisional application No. 62/095,649 filed Dec. 22, 2014. All subject matter set forth in provisional application No. 62/095,649 filed Dec. 22, 2014 is hereby incorporated by reference into the present application as if fully set forth herein.

BACKGROUND OF THE INVENTION

Field of the Invention

This invention relates to separator systems and more particularly to an improved separator system for organizing items such as a folded fabric, wearing apparel, documents or other materials.

Description of the Related Art

Various types of separators and separator systems have been devised in the past for sorting various types of items. These separators and separator systems vary in complexity from very simple to very complex separators and separator systems. Furthermore, these separators and separator systems vary quite diversely in accordance with the type, size and shape of the items separated.

Another important aspect of separators and separator systems is the ability to organize the separated items. Separators and separator systems must be able to quickly organize the items and permit rapid selection and recovery of a selected item contained within the separator system.

The following United States patents and published patent applications represent various solutions proposed by the prior art for providing a simple, inexpensive and efficient separator system.

U.S. Pat. No. 4,109,982 to K. Schreyer discloses a correspondence (or the like) filing folders and filing cabinet drawer dividers, hereinafter generally referred to as "separators" made of relatively thin and inexpensive sheet material and are novelty constructed and configured to prevent them from "slumping" when installed in a compartmented filing system; the folders/dividers being of improved functioning and increased life characteristics. An improved (optionally employed) file content "follower" contributes to an overall improved filing system.

U.S. Pat. No. 4,305,217 to L. Green discloses a partitioned structure comprising an open topped container and a plurality of dividers having sides positioned within the container. The container has horizontal interior side channels on either side thereof so that each divider having at least one tab disposed on each side thereof slides within one of the horizontal channels and permits movement of the divider relative to the container. Each divider has a projection extending above its top on which information is placed.

U.S. Pat. No. 4,795,196 to D. Hyun discloses a consumer product coupon storage device comprising a coupon storage bin and a plurality of dividers adapted to fit in the bin to separate the space in the bin into individual compartments. Each divider has first and second visible fields. A generic product descriptor is printed in the first field of each divider. A brand-name product advertisement is printed in the second field of each divider. The brand-name product belongs to the class of the generic product, the descriptor which is printed on the same divider as, or a divider near, the advertisement of said brand-name product. In use, the coupons are placed in the compartments sorted by generic product.

U.S. Pat. No. 5,505,371 to J. O'Neill discloses a shipping and display carton including an outer container and an inner partition structure. The partition structure is constructed from a single cut and scored blank of corrugated paperboard that is folded and erected to form a modified Z-type divider with three loading cells. The front wall of the outer container includes a perforated cut-out that is removed for display purposes, and each divider panel of the partition structure includes a cut-out that is compatible in size and shape with the cut-out in the front wall of the outer container.

U.S. Pat. No. 5,810,457 to D. Felsenthal discloses collapsible shelving that can be tautly suspended by a single person within an erected wardrobe frame. The shelving is comprised of eight hooks that engage top and bottom poles of the wardrobe frame, four cords that engage the hooks at each end, a plurality of staples attached to each of the cords, and a plurality of shelves that rest on the staples horizontally and in parallel with each other.

U.S. Pat. No. 6,318,822 to W. Wang discloses a clothes cabinet adapted for mounting in a wardrobe. The clothes cabinet includes a plurality of individual boxes, and at least one coupling wire rod adapted to secure the individual boxes in a stack. The individual boxes each have two vertical side panels, a horizontal bottom panel. A horizontal top panel and a plurality of upper peripheral barrels and lower peripheral barrels horizontally aligned along top and bottom sides of the respective two vertical side panels. The at least one coupling wire rod each has a curved middle section attached to the horizontal top panel of one individual box at a bottom side, and two end rod sections respectively perpendicularly extended from two distal ends of the curved middle section and inserted into the lower peripheral barrels of one of the individual boxes and the upper peripheral barrels of a second of the individual boxes.

U.S. Pat. No. 7,334,669 to D. Barker discloses wheeled luggage having a telescopically expandable body. The luggage body may be manually adjusted from a normally sized carry-on configuration during transit, to a vertically enlarged configuration once the final destination, such as a hotel room, is reached. The body further includes a plurality of interior horizontally disposed, vertically stacked shelves connected in accordion fashion to an internal liner so as to automatically expand from a compact configuration to an expanded configuration when the main body is telescopically expanded thereby providing a series of vertically spaced shelves which provide convenient access to the contents. A garment folding apparatus may be incorporated with the luggage to provide a tool that assists the user in quickly folding clothing to dimensions compatible with storage spaced within the luggage.

U.S. Pat. No. 7,779,976 to J. Mangano discloses an item of luggage that has foldable shelves and collapsible drawers. The drawers and shelves may be folded relatively flat and stored in the main housing of the luggage when not in use. The luggage may have a cover support to hold the cover of the luggage open at various angles and under various loads when the cover is open.

U.S. Pat. No. 8,376,477 to D. Schinzing discloses a storage unit for placement between upright studs of a wall. The unit may be unitary or be made into two telescoping box portions. Storage shelves are removably positioned in the interior area of the unit. For the two-piece unit, the storage shelves are made of two half shelves, with each half shelf having a terminal loop portion through which the other half shelf slides.

U.S. Pat. No. 8,714,418 to Kumar et al. discloses a clothing folding system comprising: one or more folding guides comprising two or more sections of substantially rigid material. A flexible web is disposed between any two of the two or more sections of substantially rigid material enabling the folding guide to be folded along the length of the flexible web. The one or more folding guides are sized so as to enable each folding guide to be used to place the folding guide in contact with an article of clothing, folding the article of clothing in a folding pattern defined by folding each flexible web of the folding guide. The folding guide remains folded within the article of clothing: and wherein the folding of multiple articles of clothing using the folding guides presents a plurality of articles of clothing that are substantially consistent in shape and size in their folded state. Such folded articles of clothing are suitable to be stored in a sustainable organized arrangement. A specific structure for the folding guide is provided as well as a related folding method for clothing, using the folding guide. A related method is provided for folding articles of clothing. The system may include a computer implemented system to enable a user to provide as input one or more parameters for articles of clothing and available storage spaces. The system generates a recommended set of folding guide requirements to meet the user's input parameters.

U.S. Patent publication US2008/0143222 to L. Greiner discloses a storage organizer for vanity items including a cabinet in which an interior space is formed by a first sidewall, a second sidewall opposing the first sidewall, a top wall extending from the first sidewall to the second sidewall, a bottom wall opposing the top wall and extending from the first sidewall to the second sidewall, and a back wall extending from the first sidewall to the second sidewall and from the top wall to the bottom wall. A door, for the interior space, extends between the top wall and the bottom wall and from the first sidewall to the second sidewall, opposite the back wall when in a closed to the bottom wall by a swivel joint. The swivel joint allows the cabinet to rotate 360 degrees about the base. A tri-fold mirror is provided by two additional doors provided on the sides of the organizer that may be rotated towards the front of the organizer. The exterior surfaces of the additional doors have mirrors disposed on their front surfaces.

U.S. Patent publication US 2010/0276241 to R. Malone discloses a hanging shelf system and travel organizer specifically adapted for use in combination with a suitcase wherein the shelf system is adapted to collapse to a size suitable for removable insertion within the suitcase. The shelf system is configurable between a vertically expanded configuration when deployed wherein a plurality of shelves and walls form storage compartments for receiving clothing and other travel items, and a vertically compact, stowed configuration wherein the travel shelf apparatus is compactly configured for insertion into a suitcase for travel. When the user reaches his/her destination the travel organizer may be removed from the suitcase and hung in a closet in the vertically expanded configuration with spaced shelves thereby providing the traveler with ready access to the packed articles while eliminating the need to unpack and repack.

U.S. Design Pat. D501,341 to Cassidy et al. illustrates a design for a stackable clothing divider having finger grip tabs.

U.S. Design Pat. D502,031 to Cassidy et al. illustrates a design for stackable clothing divider.

U.S. Design Pat. D505,809 to Cassidy et al. illustrates a design for stackable clothing divider having wide pulling tabs.

Although the foregoing United States patents and published patent application have contributed to the prior art, there still exits a need for a simple, low cost and efficient system to separate items.

Therefore, it is an object of the present invention to provide a separator for separating items which overcomes the deficiencies of the prior art.

Another object of the present invention to provide a separator for separating items that comprises a plurality of identical separators specifically adapted to be stacked to form a separator system.

Another object of the present invention to provide a separator for separating items that is specifically adapted to flat items.

Another object of the present invention to provide a separator for separating items that is specifically adapted to stack a plurality of flat items.

Another object of the present invention to provide a separator for separating items that is specifically adapted to fabric items such as wearing apparel, documents or other materials.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved separator system for organizing items such as a folded fabric or wearing apparel, office documents or other materials. The separator system comprises a first planar member defined by a first peripheral portion for supporting a first item. A first hollow projection is formed in the first peripheral portion of the first planar member. The first hollow projection defines a first upper projection and a first lower recess. The first upper projection of the first hollow projection extends above the first item for interlocking with a second lower recess of an adjacent second planar member located above the first item.

In a more specific embodiment, the first hollow projection is integrally formed with the first planar member as a one piece unit. Preferably, the first hollow projection is integrally formed with the first planar member as a one piece unit from a polymeric, a metallic, a wood, a fiber or any other suitable material.

In another specific embodiment, the first upper projection and the second lower recess of the adjacent second planar member are configured for inhibiting horizontal rotation of the second planar member relative to the first planar member while permitting vertical tilting of the second planar member relative to the first planar member. In one example, the first hollow projection comprises a major dimension and a minor dimension for inhibiting horizontal rotation of the second planar member relative to the first planar member. In another example, the first hollow projection comprises plural first hollow projections formed in the first peripheral portion of the first planar member for inhibiting horizontal rotation of the second planar member relative to the first planar member while permitting vertical tilting of the second planar member relative to the first planar member. In still another example, the first planar member is defined by a generally rectangular first peripheral portion. The first hollow projection comprises a first hollow projection formed in each of adjacent sides of the generally rectangular first peripheral portion of the first planar member for inhibiting horizontal rotation of the second planar member relative to the first planar member while permitting vertical tilting of the second planar member relative to the first planar member. In a further example, the first hollow projection comprises a lip extending along multiple sides of the generally rectangular first peripheral portion of the first planar member for inhibiting horizontal rotation of the second planar member relative to the first planar member while permitting vertical tilting of the second planar member relative to the first planar member.

In another embodiment, the invention is incorporated into a separator system for organizing items comprising a first planar member having a first hollow projection formed in an outer portion of the first planar member defining a first upper projection and a first lower recess. The first planar member is configured to support a first item. A second planar member has a second hollow projection formed in an outer portion of the second planar member defining a second upper projection and a second lower recess. The second planar member is configured to support a second item. The upper projection of the first hollow projection extends above the first item for interlocking with the second lower recess of the second planar member located above the first item. Preferably, the first planar member and the first hollow projection are identical to the second planar member and the second hollow projection.

The first hollow projection of the first planar member is configured for enabling an upper surface of the first planar member to engage with a lower surface of the second planar member in the absence of a first item. The first hollow projection of the first planar member is configured for enabling the upper projection of the first hollow projection extending above the first item for interlocking with the second lower recess of the second planar member in the presence of the first item. The first upper projection and the second lower recess of the adjacent second planar member are configured for inhibiting horizontal rotation of the second planar member relative to the first planar member while permitting vertical tilting of the second planar member relative to the first planar member.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which:

FIG. 20 is a top view of the second embodiment of the separator shown in FIG. 16;

FIG. 21 is a right side view of FIG. 20;

FIG. 22 is a view along line 22-22 in FIG. 20;

FIG. 23 is a view along line 23-23 in FIG. 20;

FIG. 24 is a view along line 24-24 in FIG. 20;

FIG. 25 is a view along line 25-25 in FIG. 20;

Similar reference characters refer to similar parts throughout the several Figures of the drawings.

DETAILED DISCUSSION

Figure 1:
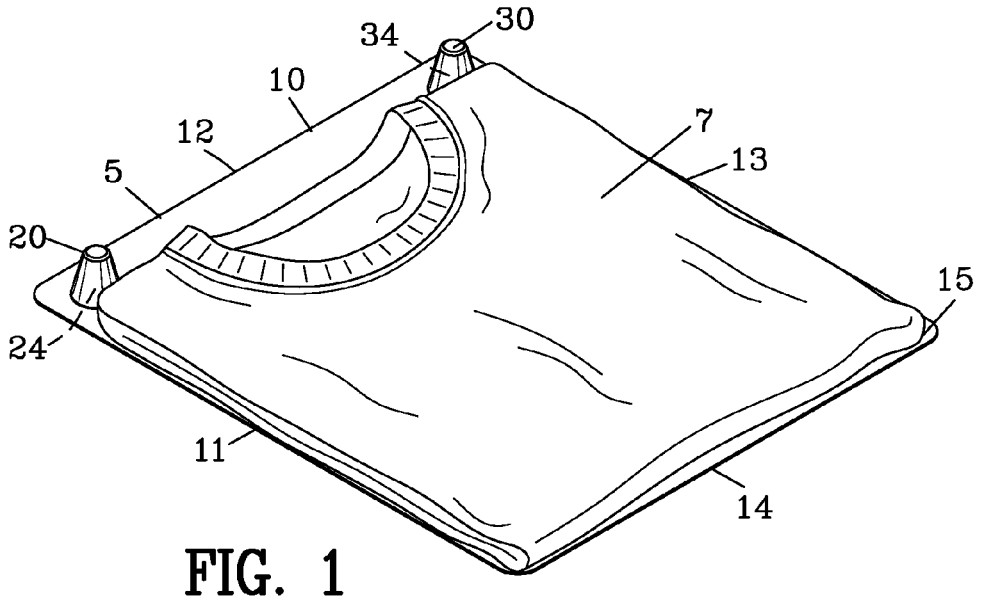
FIG. 1 is an isometric view of a first embodiment of a separator of the present invention supporting an item shown as a garment.

FIG. 1 is an isometric view of a first embodiment of a separator 5 of the present invention. The separator 5 is shown supporting an item 7 shown as flat item. In this embodiment, the item 7 is shown as a folded fabric such as wearing apparel or a garment. Although the item 7 is shown as a folded fabric such as wearing apparel or a garment, it should be understood that the separator 5 may be used with various non-fabric items such as documents or other materials.

Figure 2:
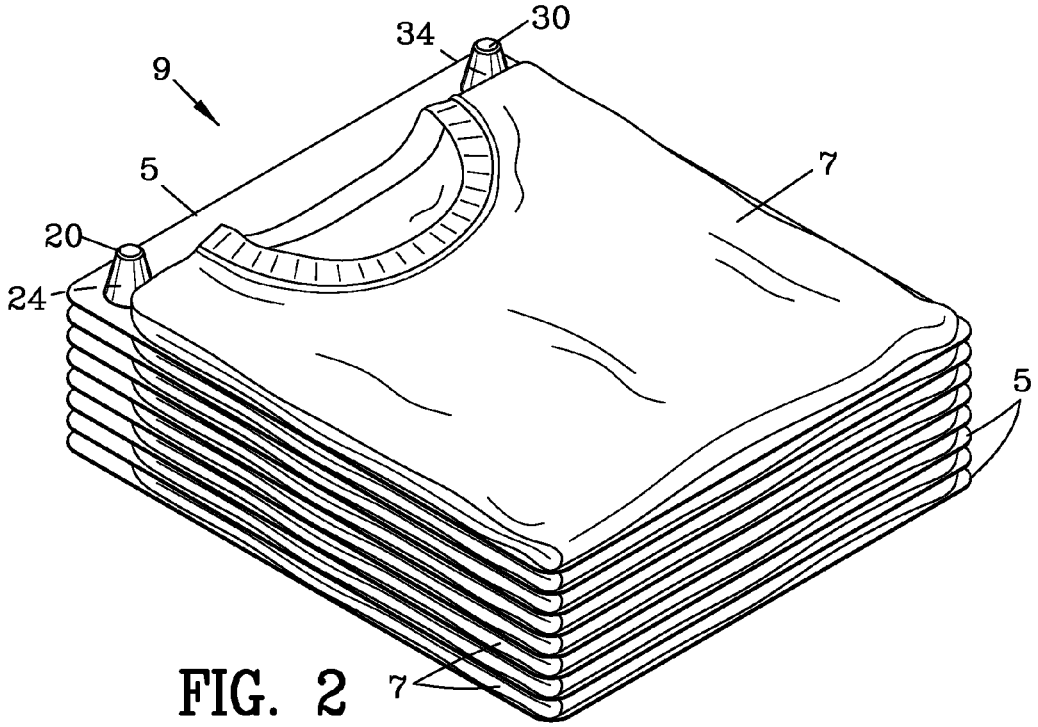
FIG. 2 is an isometric view of a stack of the separator of FIG. 1 supporting a plurality of items.
Figure 3:
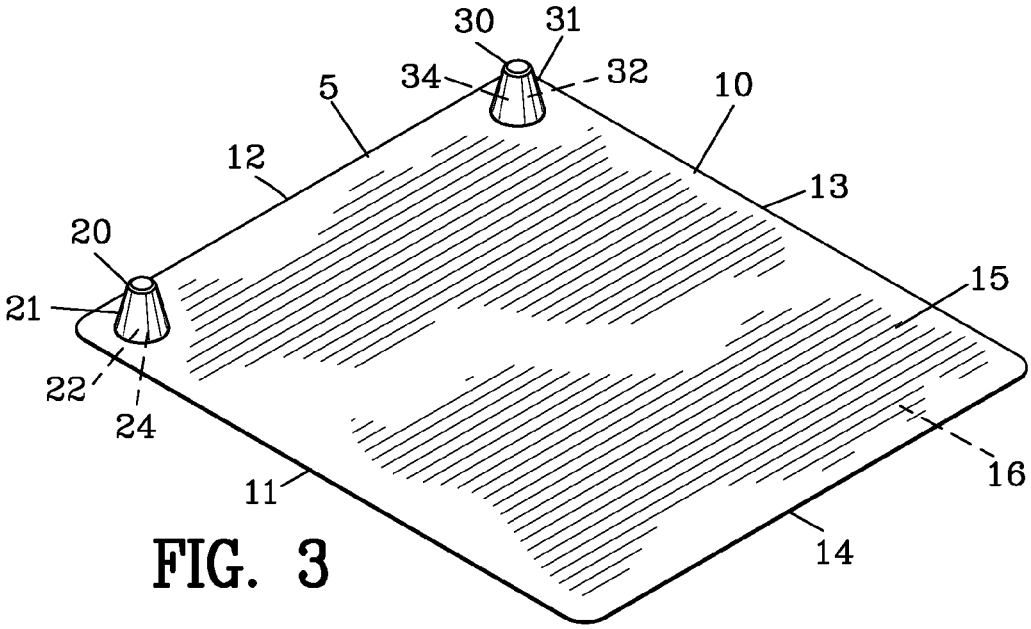
FIG. 3 is a top isometric view of the first embodiment of the separator shown in FIG. 1.
Figure 4:
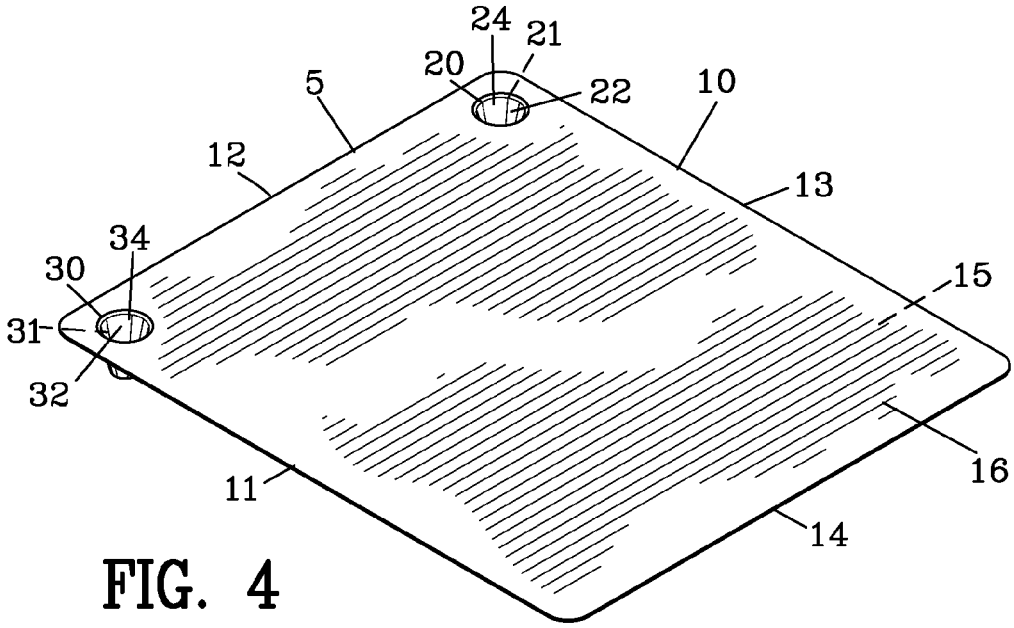
FIG. 4 is a bottom isometric view of the first embodiment of the separator shown in FIG. 1.
Figure 5:
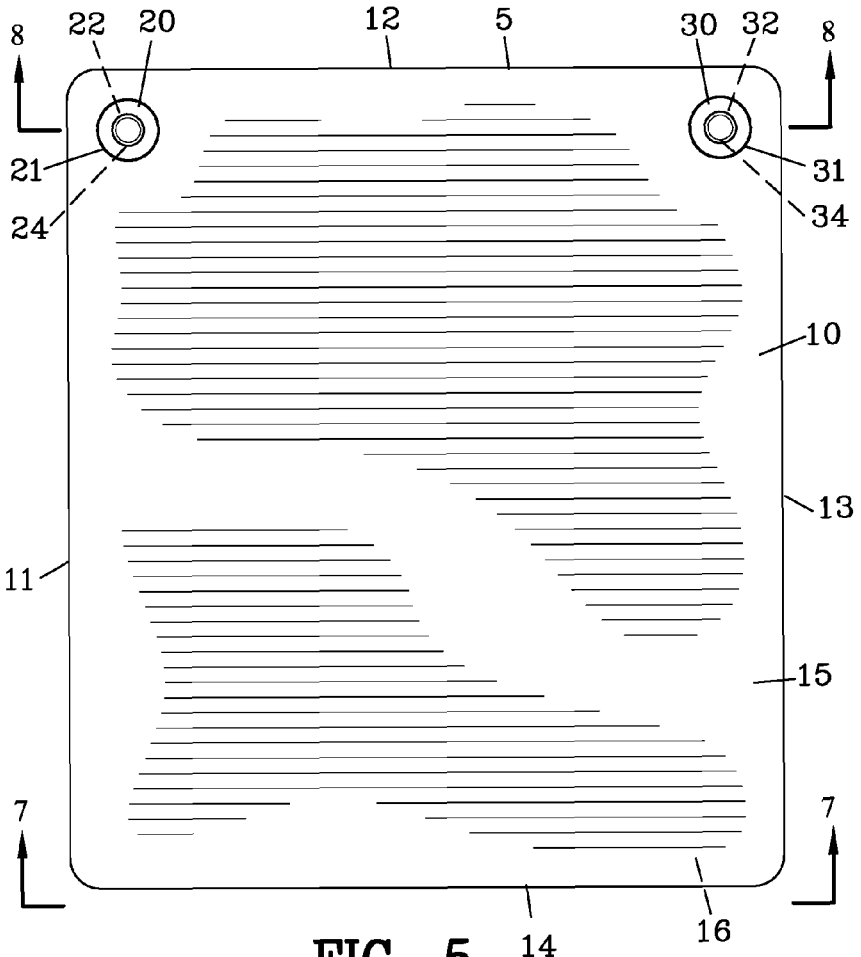
FIG. 5 is a top view of the first embodiment of the separator shown in FIG. 1.
Figure 6:
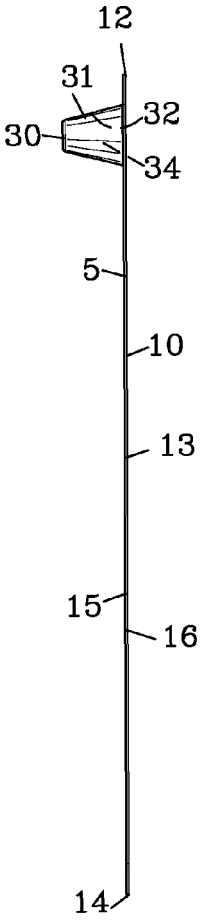
FIG. 6 is a right side view of FIG. 5.
Figure 7:
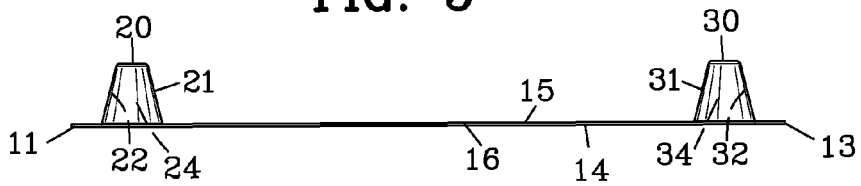
FIG. 7 is a view along line 7-7 in FIG. 5.
Figure 8:
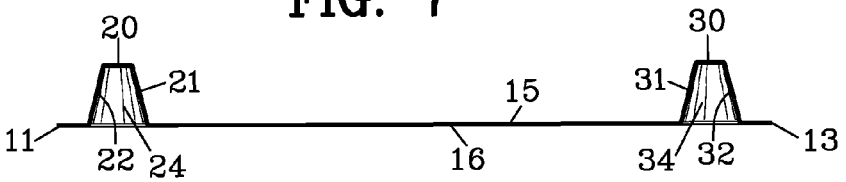
FIG. 8 is a sectional view along line 8-8 in FIG. 5.

FIG. 2 is an isometric view of a stack of the separator 5 of FIG. 1 supporting a plurality of items 7. Each of the separators 5 is identical to one another. The stack of the separator 5 forms a separator system 9 for separating a plurality of items 7.

FIGS. 3-8 are various views of the first embodiment of the separator 5 shown in FIG. 1. The separator 5 comprises a planar member 10 defined by a first peripheral portion 11, a second peripheral portion 12, a third peripheral portion 13 and a fourth peripheral portion 14. In this example, the planar member 10 is shown as a rectangular configuration but it should be understood that the planar member 10 may be embodied in other configurations.

The planar member 10 has a top surface 15 and a bottom surface 16. Preferably, the planar member 10 is a one piece unit formed from a polymeric material. In the alternative, the planar member 10 is a one piece unit formed from metallic material, a wood material or a derivative of a wood material such as cardboard and the like.

Each of the separators 5 includes a hollow projection for registering planar member 10 with an identical separator 5 located below and/or above the planar member 10. The planar member 10 has a first hollow projection 20 defined by an upper surface 21 and a first lower surface 22 forming a first hollow recess 24.

The first hollow projection 20 is located near the first peripheral portion 11 adjacent a corner defined by the intersection of the first peripheral portion 11 and the second peripheral portion 12. The first hollow projection 20 is integrally formed with the planar member 10.

In this example, the planar member 10 has a second hollow projection 30 defined by an upper surface 31 and a first lower surface 32 forming a second hollow recess 34. The second hollow projection 30 is located near the second peripheral portion 12 adjacent a corner defined by the intersection of the second peripheral portion 12 and the third peripheral portion 13.

Referring back to FIG. 2, the projections 20 and 30 of the first separator 5 extend above the item 7 resting on the top surface 15. The projections 20 and 30 of the first separator 5 interlock with recesses 24 and 34 of an upper second separator 5 to form the separator system. The interlocking of the projections 20 and 30 of a first separator 5 with recesses 24 and 34 of an upper second separator 5 inhibits horizontal rotation between the first and second separators 5. The interlocking of the projections 20 and 30 of a first separator 5 with recesses 24 and 34 of an upper second separator 5 permits vertical tilting of the second planar member relative to the first planar member. Furthermore, the projections 20 and 30 of the first separator 5 fit within recesses 24 and 34 of the upper second separator 5 allowing the separators 5 to nest when not in use.

Figure 9:
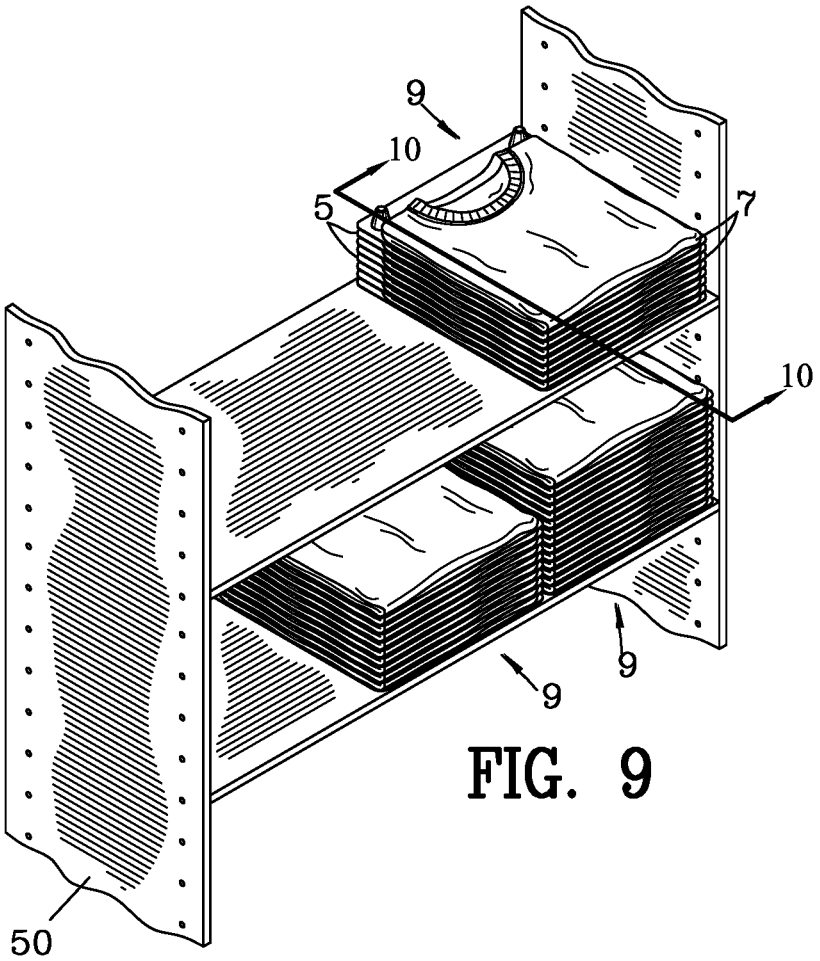
FIG. 9 is an isometric view of a stack of the separators of FIG. 1 located on a conventional storage shelve.

FIG. 9 is a view of a stack of the separators 5 of FIG. 1 located on a conventional storage shelve 50. The separator system 9 of the present invention enables a stack of fabric or garments 7 to be conveniently and neatly arranged on the conventional storage shelve 50. In addition, the interlocking of adjacent separators 5 enables an operator to tilt and peruse all of the items 7 within the stack of separators 5. Thereafter, the interlocking of adjacent separators 5 enables the operator to vertically tilt multiple separators 5 for conveniently selecting and removing a single item 7 from the stack of separators 5. The separator system 9 may also be located and used within drawers, suitcases or exposed surfaces.

Figure 10:
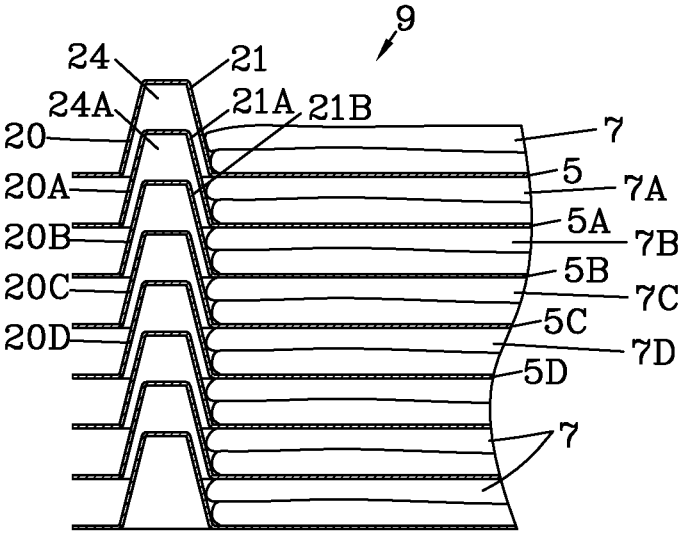
FIG. 10 is a sectional view along line 10-10 in FIG. 9.

FIG. 10 is a sectional view along line 10-10 in FIG. 9 illustrating the interlocking hollow projections 20 of the stack of separators five shown in FIG. 9. The stack of separators is shown including separators 5, 5A, 5B, 5C and 5D. The separators 5-5D support items 7, 7A, 7B, 7C, 7D. The separators 5, 5A, 5B, 5C and 5D include projections 20, 20A, 20B, 20C and 20 D. Each of the projections 20, 20A, 20B, 20C and 20 D extend above the respective items 7, 7A, 7B, 7C, 7D thus interlocking the separators 5, 5A, 5B, 5C and 5D.

Figure 11:
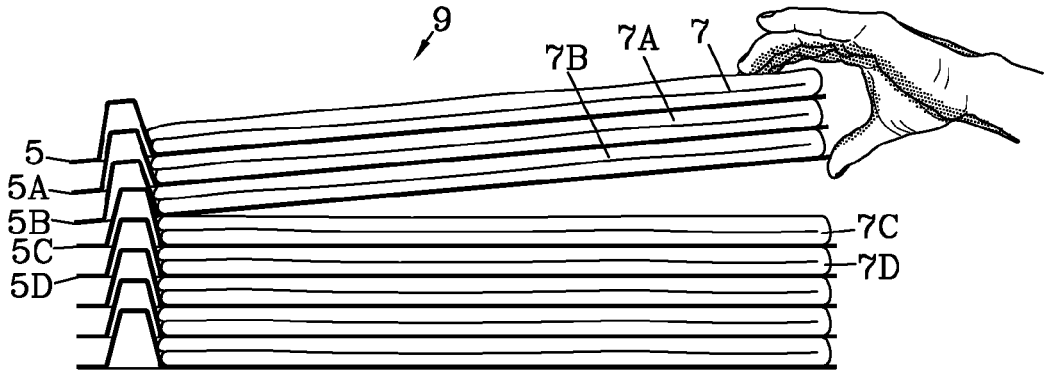
FIG. 11 is a side view of a stack of the separator of FIG. 1 being lifted to retrieve an item within the stack.

FIG. 11 is a side view of a stack of the separators 5 of FIG. 1 being vertically tilted or lifted to retrieve an item 7 within the stack of the separators 5. In this example, the separators 5, 5A and 5B are being vertically tilted or lifted to expose items 7C.

Figure 12:
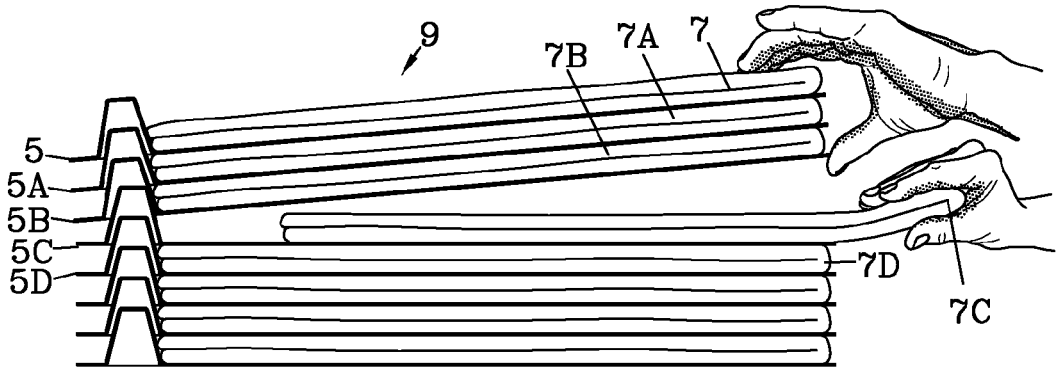
FIG. 12 is a view similar to FIG. 11 illustrating the retrieval of an item within the stack.

FIG. 12 is a view similar to FIG. 11 illustrating the retrieval of an item 7C within the stack of the separators 5. The vertically tilting or lifting of the separators 5. 5A, 5B facilitates removal of the item 7C from separator 5C.

Figure 13:
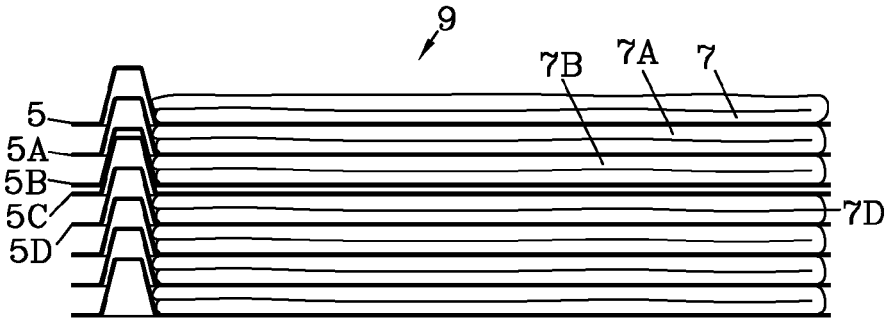
FIG. 13 is a view similar to FIG. 12 illustrating the stack of the separator after removal of the item from the stack.

FIG. 13 is a view similar to FIG. 12 illustrating the stack of the separators 5 after removal of the item 7C from separator 5C of the stack of the separators 5. After removal of the item 7C from the separator 5C, the separator 5B interlocks with separator 5C. In the alternative, the stack of separators 5, 5A and 5B may be lifted vertically to remove the separator 5C from the stack of the separators 5 with the separator 5B interlocking with separator 5D.

Figure 14:
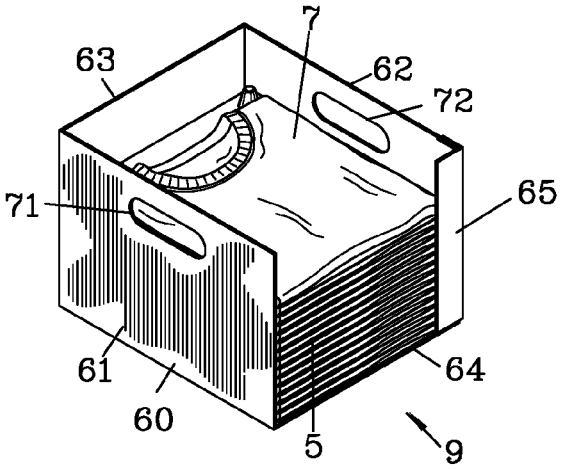
FIG. 14 is an isometric view of a stack of the separator of FIG. 1 located in a stack container suitable for incorporation into the present invention.

FIG. 14 is an isometric view of a stack of the separator 5 of FIG. 1 located in a stack container 60 suitable for incorporation into the present invention. The stack container 60 comprises a first and a second side 61 and 62 interconnected by a back 63 and a bottom 64. The first and second side 61 and 62 define handles 71 and 72. The stack container 60 is configured to receive a stack of the separators 5 to further organize the items 7. The stack container 60 may be formed from various materials such as cardboard materials, polymeric materials or metallic materials. In addition, the stack container 60 may comprise a shipping container for a stack of new separators 5.

Figure 15:
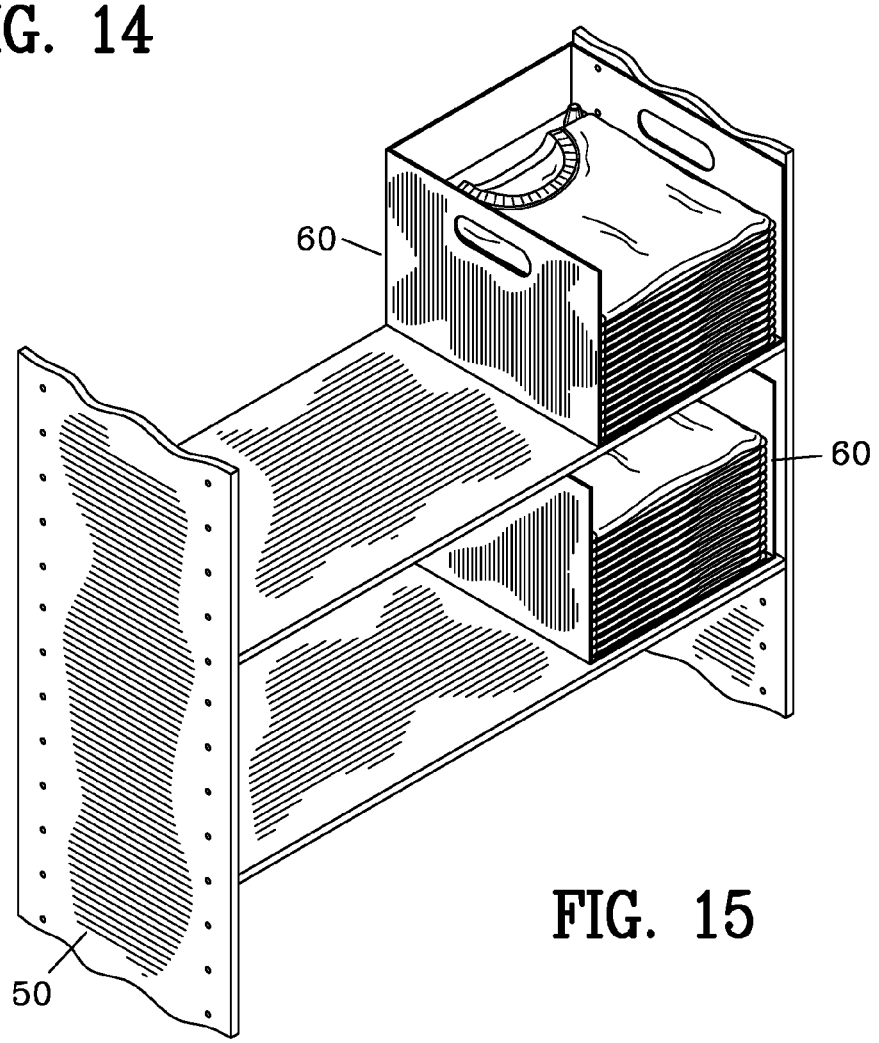
FIG. 15 is an isometric view of the stack container of FIG. 14 located on a conventional storage shelve.

FIG. 15 is an isometric view of the stack container 60 of FIG. 14 located on a conventional storage shelve. The stack container 60 in combination with the separators system 9 of the present invention further organizes the items 7.

Figure 16:
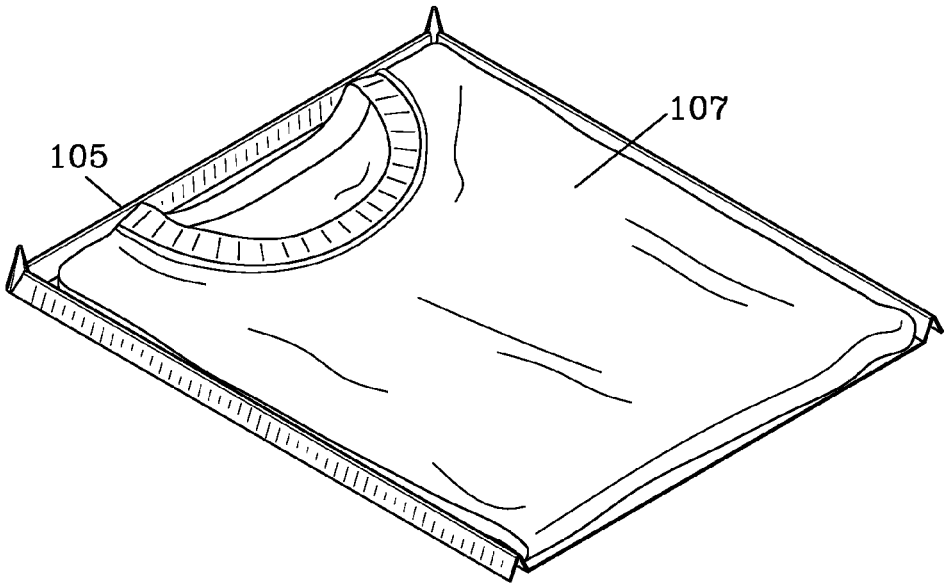
FIG. 16 is an isometric view of a second embodiment of a separator of the present invention supporting an item shown as a garment.

FIG. 16 is an isometric view of a second embodiment of a separator 105 of the present invention. The separator 105 is shown supporting an item 107 in a manner similar to FIG. 1.

Optionally, the container 60 may be provided with a tab 65 located on the side 62 of the container 60. The tab 65 interacts with separators 5 to restrict horizontal movement of the separators 5 thereby locking separators 5 within container 60. The tabs 65 may be retractable or removable from interaction with separators 5. It should be appreciated by those skilled in the art that the tab 65 may take various forms and may be affixed at various locations of the container 60.

Figure 17:
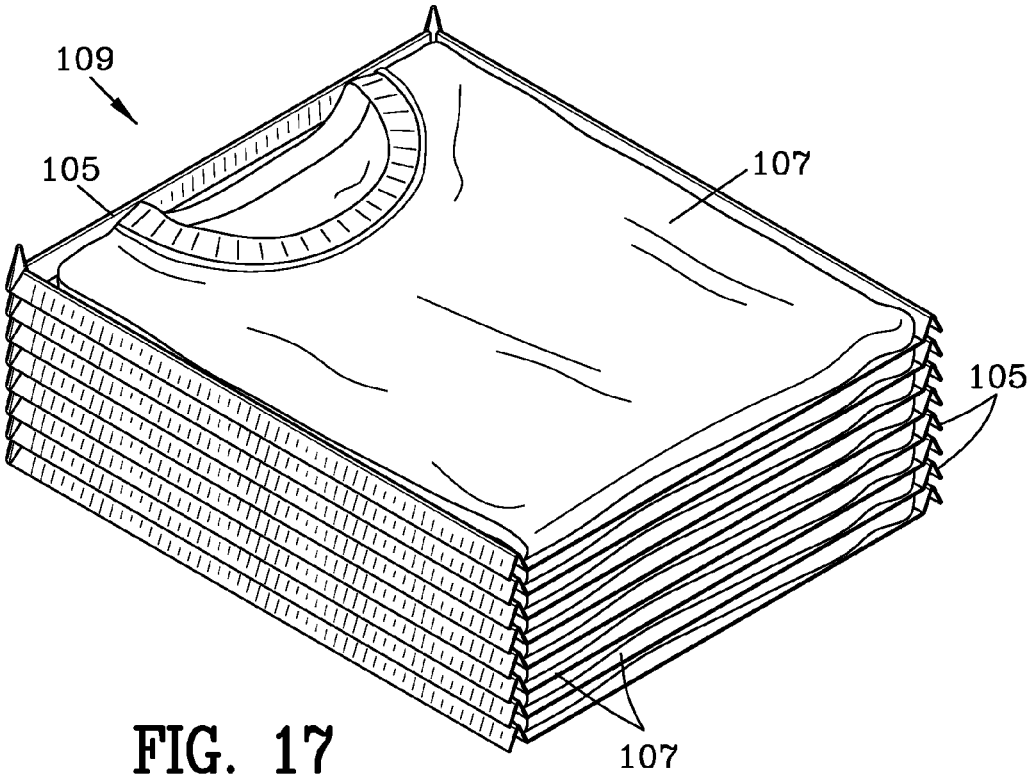
FIG. 17 is an isometric view of a stack of the separators of FIG. 16 supporting a plurality of items.
Figure 18:
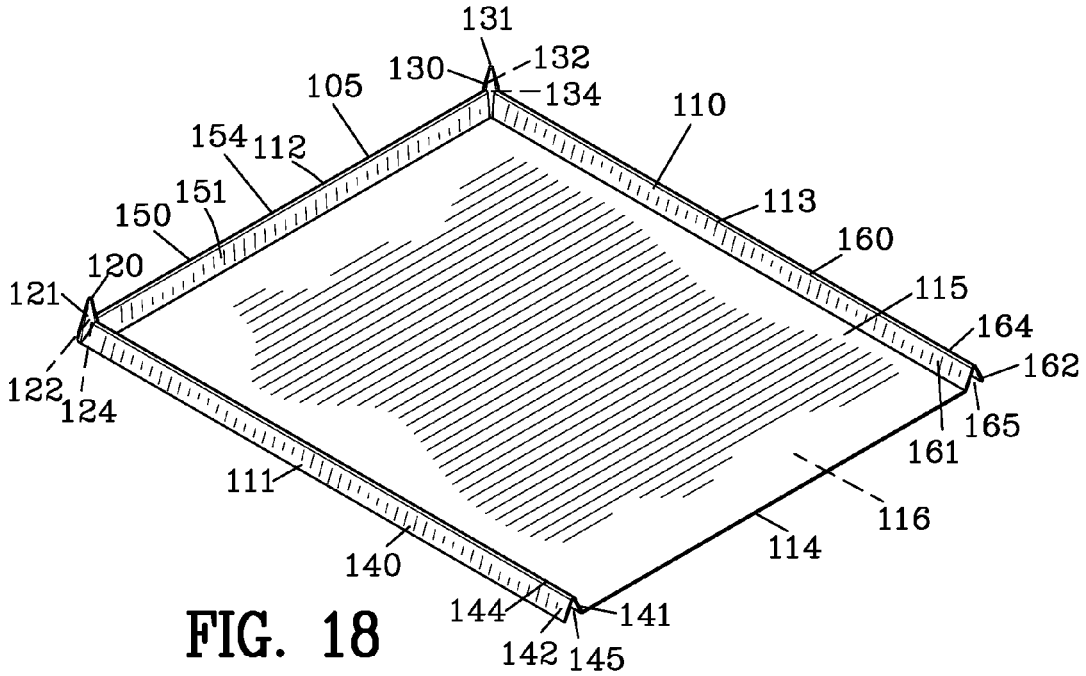
FIG. 18 is a top isometric view of the second embodiment of the separator shown in FIG. 16.
Figure 19:
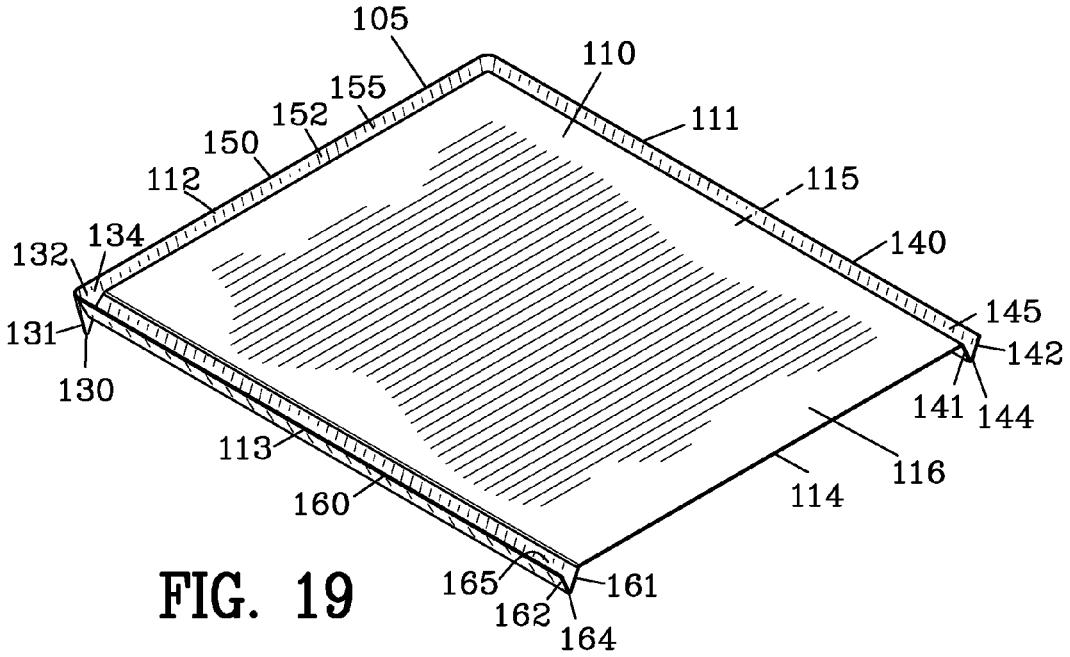
FIG. 19 is a bottom isometric view of the second embodiment of the separator shown in FIG. 16.

FIG. 17 is an isometric view of a stack of the separators 105 of FIG. 16 supporting a plurality of items 107. Each of the separators 105 is identical to one another. The stack of the separator 105 forms a separator system 109 for separating a plurality of items 107.

FIGS. 18-23 are various views of the second embodiment of the separator 105 shown in FIG. 16. The separator 105 comprises a planar member 110 defined by a first peripheral portion 111, a second peripheral portion 112, a third peripheral portion 113 and a fourth peripheral portion 114. In this example, the planar member 110 is shown as a rectangular configuration but it should be understood that the planar member 110 may be embodied in other configurations.

Each of the separators 105 includes a hollow projection for registering planar member 110 with an identical separator 105 located below and/or above the planar member 110. The planar member 110 has a first hollow projection 120 defined by an upper surface 121 and a first lower surface 122 forming a first hollow recess 124.

The first hollow projection 120 is located near the first peripheral portion 11 adjacent a corner defined by the intersection of the first peripheral portion 111 and the second peripheral portion 112. The first hollow projection 120 is integrally formed with the planar member 110.

In this example, the planar member 110 has a second hollow projection 130 defined by an upper surface 131 and a first lower surface 132 forming a second hollow recess 134. The second hollow projection 130 is located near the second peripheral portion 112 adjacent a corner defined by the intersection of the second peripheral portion 112 and the third peripheral portion 113.

The separator 105 comprises a first, second and a third lip 140, 150 and 160 defined by the first peripheral portion 111, the second peripheral portion 112, and the third peripheral portion 113. The first, second and a third lips 140, 150 and 160 add mechanical strength to the separator 105. Furthermore, the first, second and a third lips 140, 150 and 160 assist in preventing lateral movement of an item 107 on the upper surface 115 of the planar member 110.

The first lip 140 comprises an inner lip 141 and an outer lip 142 forming an apex 144 and the recess 145. Similarly, the second lip 150 comprises an inner lip 151 and an outer lip 152 forming an apex 154 and the recess 155. Finally, the third lip 160 comprises an inner lip 161 and an outer lip 162 forming an apex 164 and the recess 165. The first, second and a third lip 140, 150 and 160 are configured to nest within one another as described with reference to the first embodiment of the invention.

Figure 26:
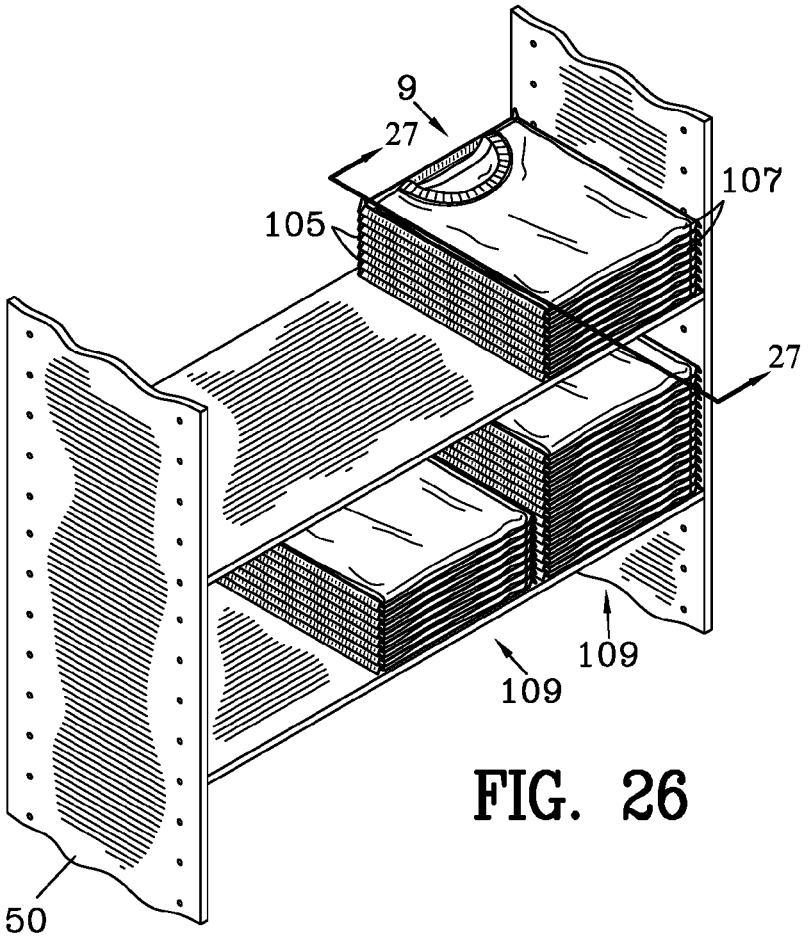
FIG. 26 is an isometric view of a stack of the separator of FIG. 16 located on a storage shelve.

FIG. 26 is a view of a stack of the separators 105 of FIG. 17 located on a conventional storage shelf 50. The separator system 109 of the present invention enables a stack of fabric or garments 7 to be conveniently and neatly arranged on the conventional storage shelve 50. In addition, the interlocking of adjacent separators 105 enables an operator to remove multiple separators 105 for conveniently selecting and removing a single item 107 from the stack of separators 105. Furthermore, the interlocking of adjacent separators 105 enables an operator to vertically tilt multiple separators 5 for conveniently selecting and removing a single item 107 from the stack of separators 105.

Figure 27:
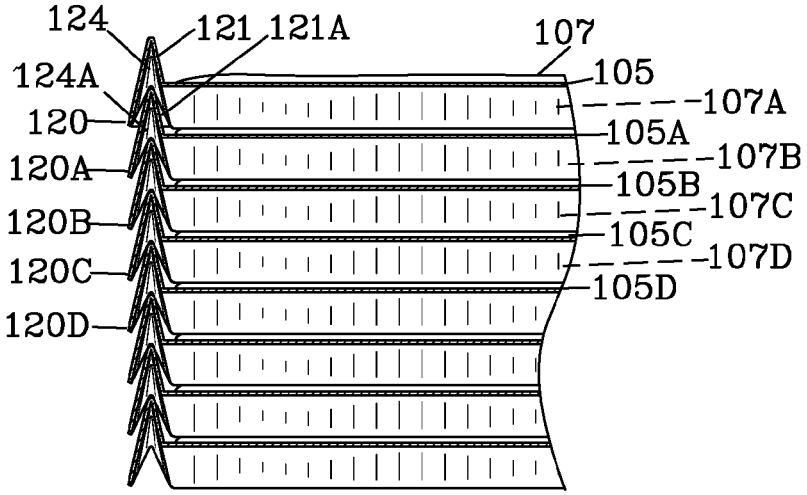
FIG. 27 is a sectional view along line 27-27 in FIG. 26.

FIG. 27 is a sectional view along line 27-27 in FIG. 26 illustrating the interlocking of the stack of separators 5 shown in FIG. 17. The stack of separators is shown including separators 105, 105A, 105B, 105C and 105D. The separators 105-105D support items 107, 107A, 107B, 107C, 107D. The separators 105, 105A, 105B, 105C and 105D include projections 120, 120A, 120B, 120C and 120 D. Each of the projections 120, 120A, 120B, 120C and 120D extend above the respective items 107, 107A, 107B, 107C, 107D thus interlocking the separators 105, 105, 105B, 105C and 105D.

Figure 28:
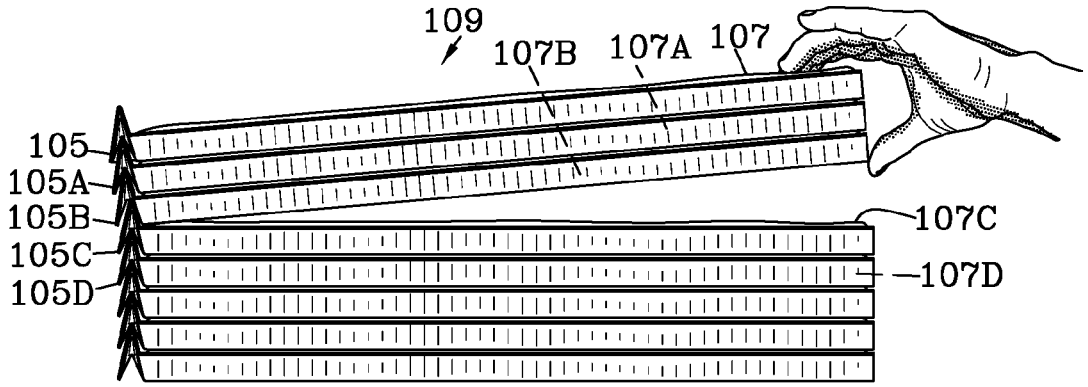
FIG. 28 is a side view of a stack of the separator of FIG. 16 being lifted to retrieve an item within the stack.

FIG. 28 is a side view of a stack of the separators 105 of FIG. 27 being lifted to retrieve an item 107 within the stack of the separators 105. In this example, the separators 105, 105A and 105B are being vertically tilted or lifted to expose item 107C.

Figure 29:
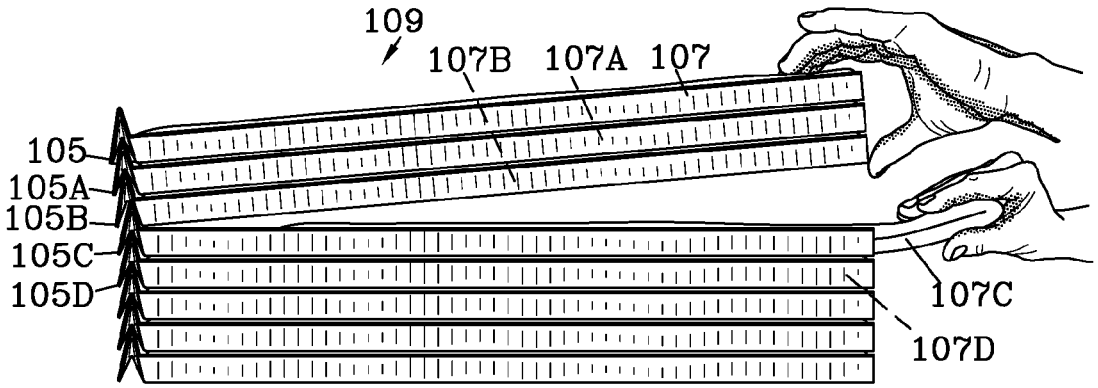
FIG. 29 is a view similar to FIG. 28 illustrating the retrieval of an item within the stack.

FIG. 29 is a view similar to FIG. 28 illustrating the retrieval of an item 107C within the stack of the separators 105. The vertical tilting or lifting of the separators 105. 105A, 105B facilitates removal of the item 107C.

Figure 30:
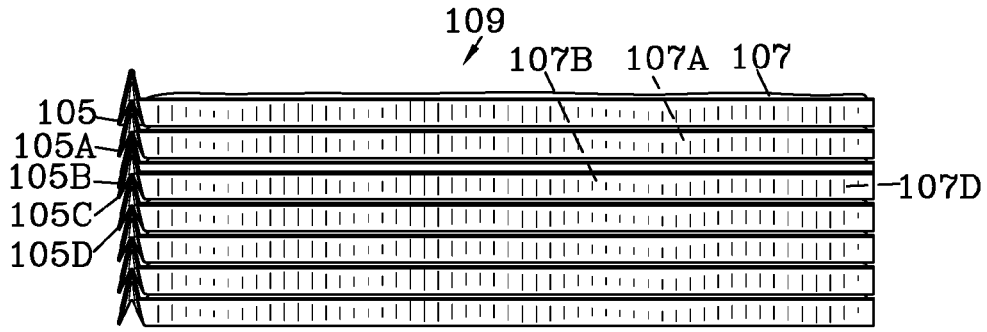
FIG. 30 is a view similar to FIG. 28 illustrating the stack of the separator after removal of the item from the stack.

FIG. 30 is a view similar to FIG. 29 illustrating the stack of the separators 105 after removal of the item 107C from the stack of the separators 105. After removal of the item 107C from the stack of separate separators 105, the separator 105B nests upon separator 105C.

Figure 31:
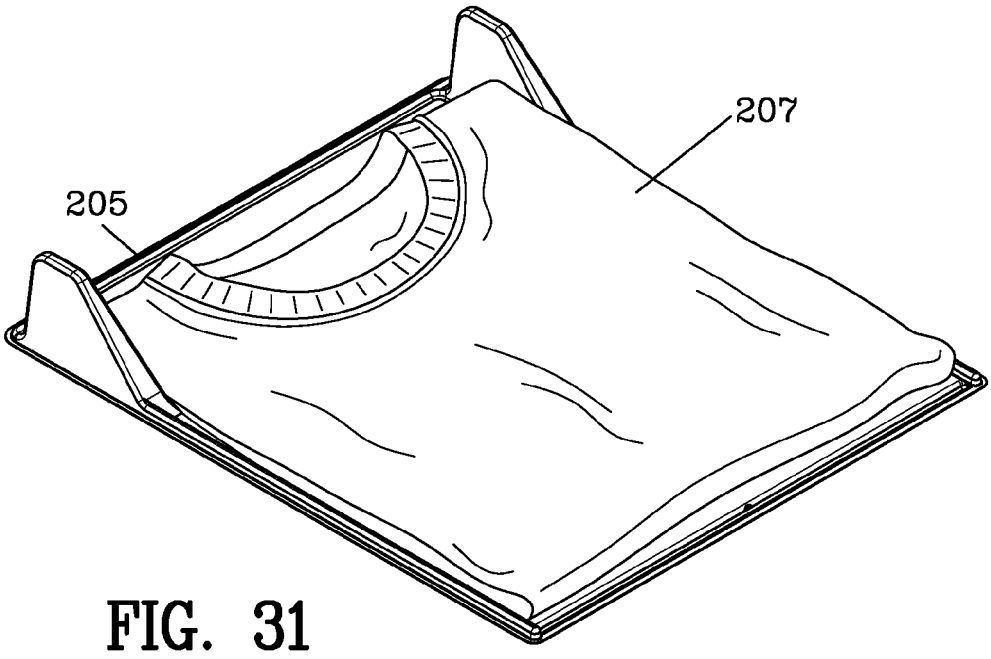
FIG. 31 is an isometric view of a third embodiment of a separator of the present invention supporting an item shown as a garment.

FIG. 31 is an isometric view of a third embodiment of a separator 205 of the present invention. The separator 205 is shown supporting an item 207 in a manner similar to FIGS. 1 and 16.

Figure 32:
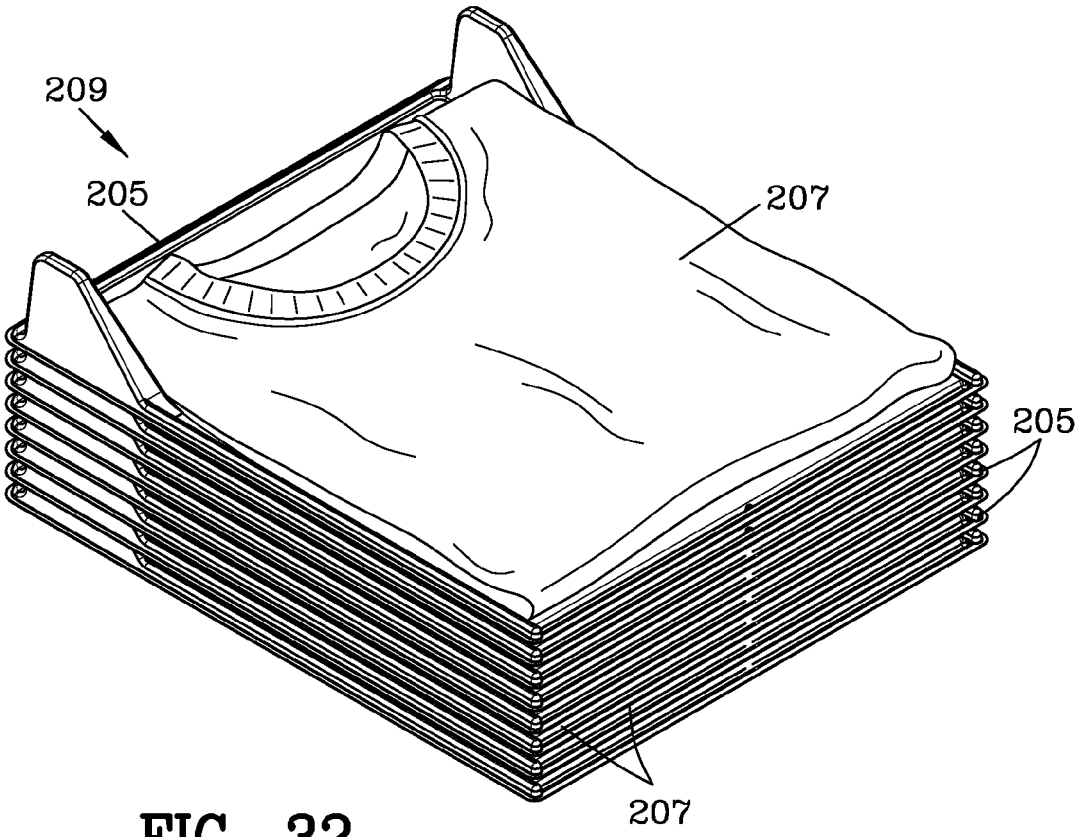
FIG. 32 is an isometric view of a stack of the separators of FIG. 30 supporting a plurality of items.
Figure 33:
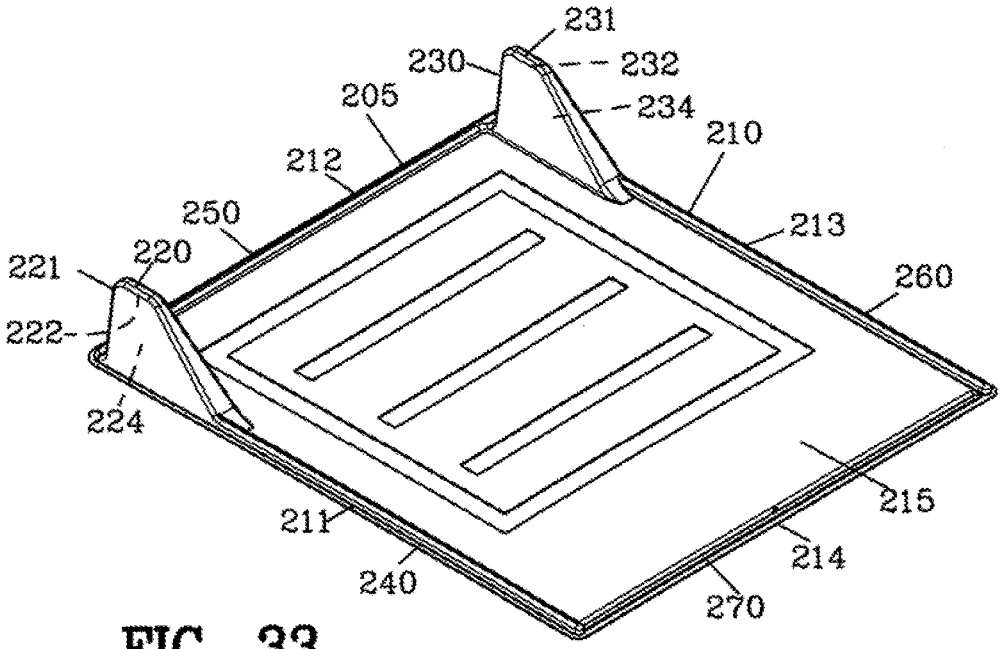
FIG. 33 is a top isometric view of the third embodiment of the separator shown in FIG. 31.
Figure 34:
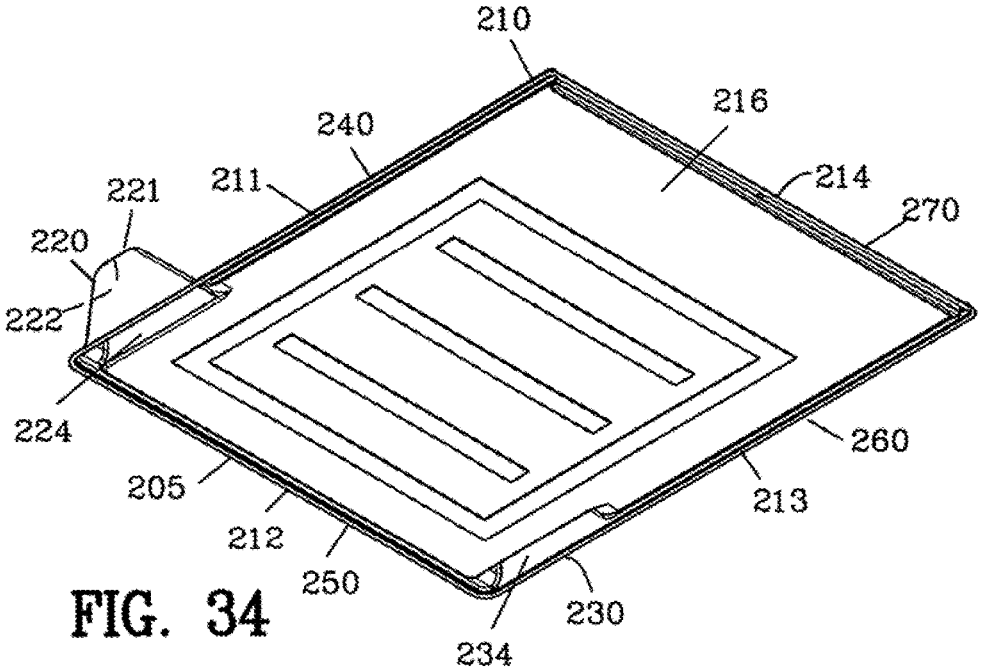
FIG. 34 is a bottom isometric view of the third embodiment of the separator shown in FIG. 31.

FIG. 32 is an isometric view of a stack of the separators 205 of FIG. 31 supporting a plurality of items 207. Each of the separators 205 is identical to one another. The stack of the separator 205 forms a separator system 209 for separating a plurality of items 207.

FIGS. 33-44 are various views of the third embodiment of the separator 205 shown in FIG. 31. The separator 205 comprises a planar member 210 defined by a first peripheral portion 211, a second peripheral portion 212, a third peripheral portion 213 and a fourth peripheral portion 214. The planar member 210 may be provided with one or more depressions 218 for strengthening and reducing flexibility of the planar member 210. In this example, the planar member 110 is shown as a rectangular configuration but it should be understood that the planar member 210 may be embodied in other configurations.

Each of the separators 205 includes a hollow projection for registering planar member 210 with an identical separator 205 located below and/or above the planar member 210. The planar member 210 has a first hollow projection 220 defined by an upper surface 221 and a first lower surface 222 forming a first hollow recess 224. The first hollow projection 220 is located near the first peripheral portion 211 adjacent a corner defined by the intersection of the first peripheral portion 211 and the second peripheral portion 212. The first hollow projection 220 is integrally formed with the planar member 210.

The first hollow projection 220 comprises an outer side 225 and an inner side 226. The outer side 225 and the inner side 226 are slightly inwardly tapered from the planar member 210 to the upper surface 221 to facilitate removal from a mold during the manufacturing process. The first hollow projection 220 comprises a first and a second ends 227 and 228. The first end 227 is substantially inwardly tapered from the planar member 210 to the upper surface 221 to facilitate the vertical tilting or lifting of the separators 205 to facilitate removal of the item 207 as shown in FIG. 28. The second end 228 is slightly tapered from the planar member 210 to the upper surface 221 to facilitate removal from a mold during the manufacturing process. However, the second end 228 has a substantially vertical orientation to prevent the forward horizontal movement of the separators 205

In this example, the planar member 210 has a second hollow projection 230 defined by an upper surface 231 and a first lower surface 232 forming a second hollow recess 234. The second hollow projection 230 is located near the second peripheral portion 212 adjacent a corner defined by the intersection of the second peripheral portion 212 and the third peripheral portion 213. The second hollow projection 230 is integrally formed with the planar member 210.

The second hollow projection 230 comprises an outer side 235 and an inner side 236. The outer side 235 and the inner side 236 are slightly inwardly tapered from the planar member 210 to the upper surface 231 to facilitate removal from a mold during the manufacturing process. The second hollow projection 230 comprises a first and a second ends 237 and 238. The first end 237 is substantially inwardly tapered from the planar member 210 to the upper surface 221 to facilitate the vertical tilting or lifting of the separators 205 to facilitate removal of the item 207 as shown in FIG. 28. The second end 238 is slightly tapered from the planar member 210 to the upper surface 221 to facilitate removal from a mold during the manufacturing process. However, the second end 238 has a substantially vertical orientation to prevent the forward horizontal of the separators 205

The separator 205 comprises a first through fourth lip 240, 250, 260 and 270 defined by the first through fourth peripheral portions 211-214. The first through fourth peripheral portions 211-214 add mechanical strength to the separator 205. Furthermore, the first through fourth peripheral portions 211-214 assist in preventing lateral movement of an item 107 on the upper surface 215 of the planar member 210.

Figure 35:
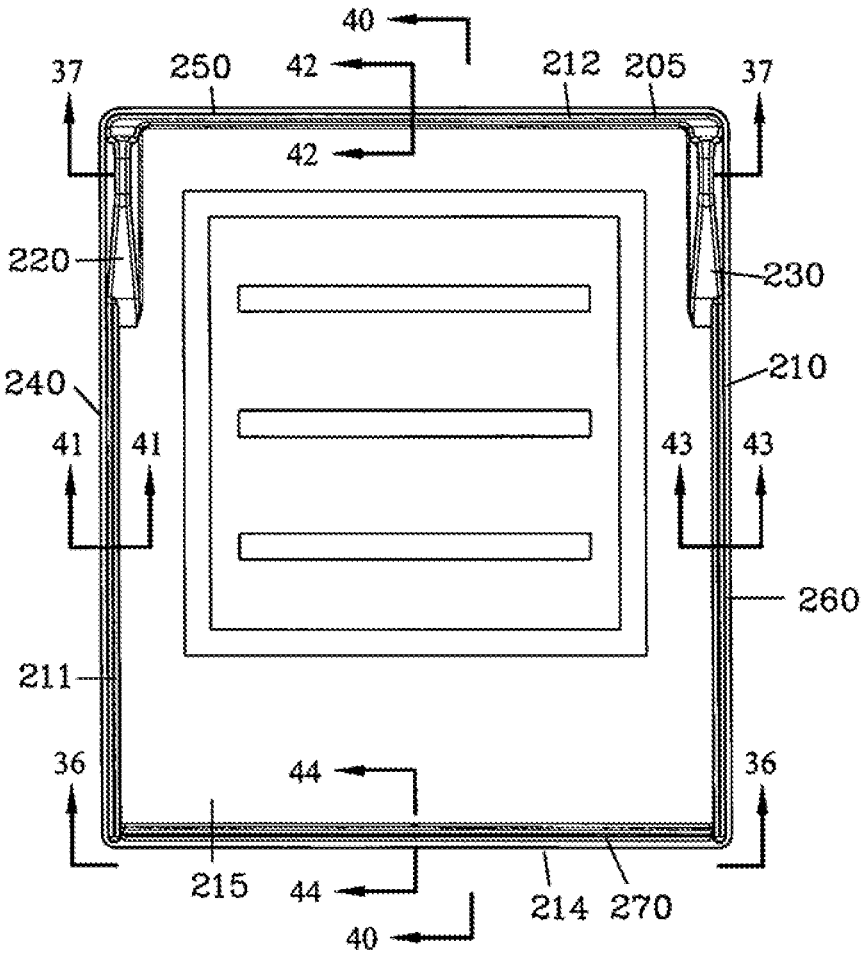
FIG. 35 is a top view of the third embodiment of the separator shown in FIG. 31.
Figure 36:
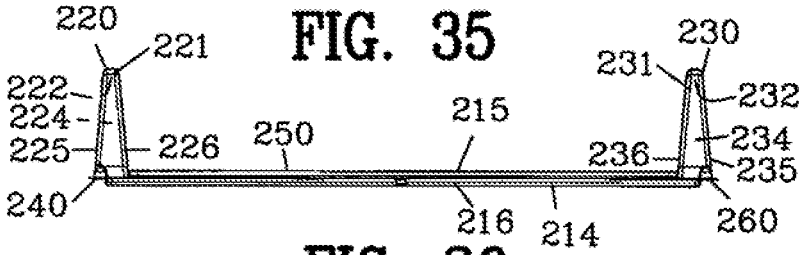
FIG. 36 is a view along line 36-36 in FIG. 35.
Figure 37:
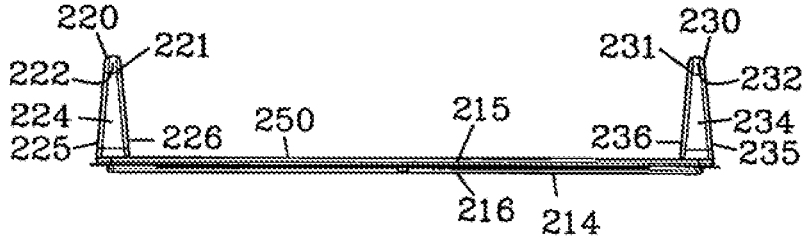
FIG. 37 is a view along line 37-37 in FIG. 35.
Figure 38:
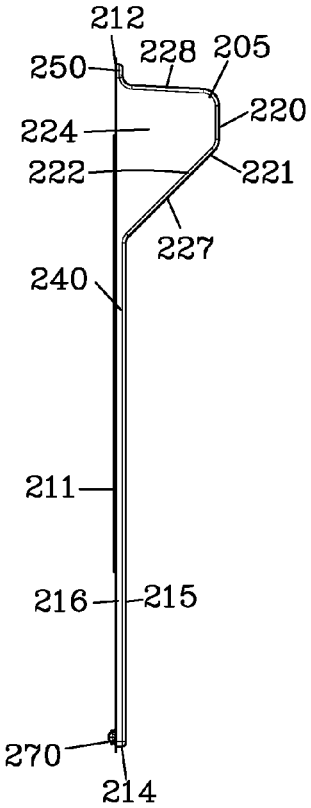
FIG. 38 is a left side view of FIG. 35.
Figure 40:
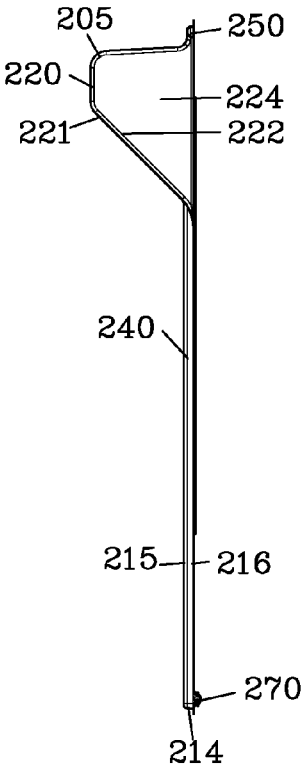
FIG. 40 is a sectional view along line 40-40 in FIG. 35.
Figure 39:
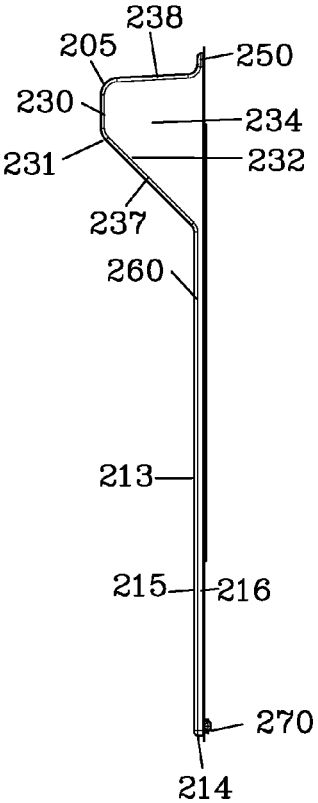
FIG. 39 is a right side view of FIG. 35.
Figure 41:
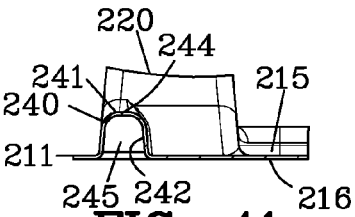
FIG. 41 is an enlarged view along line 41-41 in FIG. 35.

FIG. 41 is a magnified view along line 41-41 in FIG. 35 further illustrating the first lip 240. The first lip 240 is formed as a generally half cylindrical configuration having an outer lip surface 241 and an inner lip surface 242 defining a peak 244 and the recess 245.

Figure 42:
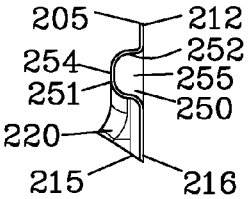
FIG. 42 is an enlarged view along line 42-42 in FIG. 35.

FIG. 42 is a magnified view along line 42-42 in FIG. 35 further illustrating the second lip 250. The second lip 250 is formed as a generally half cylindrical configuration having an outer lip surface 251 and an inner lip surface 252 defining a peak 254 and the recess 255.

Figure 43:
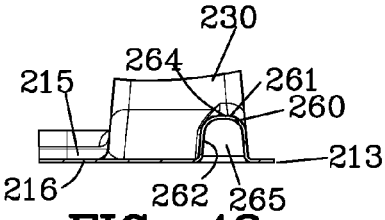
FIG. 43 is an enlarged view along line 43-43 in FIG. 35.

FIG. 43 is a magnified view along line 43-43 in FIG. 35 further illustrating the third lip 260. The third lip 260 is formed as a generally half cylindrical configuration having an outer lip surface 261 and an inner lip surface 262 defining a peak 264 and the recess 265.

Figure 44:
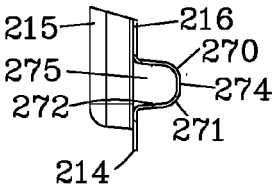
FIG. 44 is an enlarged view along line 44-44 in FIG. 35.

FIG. 44 is a magnified view along line 44-44 in FIG. 35 further illustrating the fourth lip 270. The fourth lip 270 is formed having a semi-half cylindrical configuration having an outer lip surface 271 and an inner lip surface 272 defining a peak 274 and the recess 275. In contrast to the first through third lips 240, 250 and 260, the fourth lip 270 is inverted relative the first through third lips 240, 250 and 260. The inversion of the fourth lip 270 facilitates the removal or sliding off of an item 207 while adding mechanical strength to the fourth peripheral portion 214.

The third embodiment of the invention shown in FIGS. 31-44 is suitable for use on a conventional storage shelve 50 as shown in FIG. 26 and is suitable for use in laundry rooms, within dresser drawers, suitcases or any other place people store or sort items.

The third embodiment of the invention shown in FIGS. 31-44 operates in a manner similar to the second embodiment of the separator 105 illustrated in FIGS. 27-30. The separator 205 may be stacked in an interlocking relationship as shown in FIG. 27. The separator 205 may be lifted to retrieve an item 207 within the stack of the separators 205 as shown in FIG. 28 and returned to the stack location as shown in FIG. 30.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A separator system for organizing and separating a first and a second item, comprising:

a first planar member having a first hollow projection formed in an outer portion of said first planar member with said first hollow projection defining a first hollow recess within an interior of said first hollow projection;

said first planar member configured to support the first item;

a second planar member having a second hollow projection formed in an outer portion of said second planar member with said second hollow projection defining a second hollow recess within an interior of said second hollow projection;

said second planar member configured to support the second item;

said first planar member being identical to said second planar member;

said first hollow projection extending above the first item for interlocking with said second hollow recess of said second planar member located above the first item; and said first hollow projection of said first planar member and said second hollow recess of said adjacent second planar member being configured for inhibiting horizontal rotation of said second planar member relative to said first planar member while permitting vertical tilting of said second planar member relative to said first planar member.

2. A separator system for organizing items as set forth in claim 1, wherein said first hollow projection comprises a major dimension and a minor dimension for inhibiting horizontal rotation of said second planar member relative to said first planar member while permitting vertical tilting of said second planar member relative to said first planar member.

3. A separator system for organizing and separating a first and a second item, comprising:

a first planar member having a first hollow projection formed in an outer portion of said first planar member with said first hollow projection defining a first hollow recess;

said first planar member configured to support the first item;

a second planar member having a second hollow projection formed in an outer portion of said second planar member with said second hollow projection defining a second hollow recess;

said second planar member configured to support the second item;

said first planar member being identical to said second planar member;

said first hollow projection of said first planar member extending above the first item;

said first hollow projection of said first planar member comprises plural first hollow projections and plural first hollow recesses;

said second hollow projection of said second planar member comprises plural second hollow projections and plural second hollow recesses; and said first plural hollow projections extending above the first item for interlocking with said second plural hollow recess of said second planar member located above the first item inhibiting horizontal rotation of said second planar member relative to said first planar member while permitting vertical tilting of said second planar member relative to said first planar member.

4. A separator system for organizing items as set forth in claim 1, wherein each of said first and second planar member are defined by a generally rectangular portion;

said first hollow projection includes a lip extending along multiple sides of said generally rectangular portion of said first planar member; and said second hollow projection includes a lip extending along multiple sides of said generally rectangular portion of said second planar member for inhibiting horizontal rotation of said second planar member relative to said first planar member while permitting vertical tilting of said second planar member relative to said first planar member.

5. A separator system for organizing and separating a first and a second item, comprising:

a first planar member having a first hollow projection formed in an outer portion of said first planar member with said first hollow projection defining a first hollow recess;

said first planar member configured to support the first item;

a second planar member having a second hollow projection formed in an outer portion of said second planar member with said second hollow projection defining a second hollow recess;

said second planar member configured to support the second item;

said first planar member being identical to said second planar member;

said first hollow projection extending above the first item;

said first hollow projection comprises plural first hollow projections and plural first hollow recesses;

said second hollow projection comprising plural second hollow recesses; and said plural first hollow projections interlocking with said plural second hollow projections and plural second hollow recesses for inhibiting horizontal rotation of said second planar member relative to said first planar member while permitting vertical tilting of said second planar member relative to said first planar member.

* * * * *